US008973322B2

(12) United States Patent
Heron

(10) Patent No.: US 8,973,322 B2
(45) Date of Patent: Mar. 10, 2015

(54) MASONRY UNITS AND STRUCTURES FORMED THEREFROM

(71) Applicant: Rupert Heron, Westbury, NY (US)

(72) Inventor: Rupert Heron, Westbury, NY (US)

( * ) Notice: Subject to any disclaimer, the term of this patent is extended or adjusted under 35 U.S.C. 154(b) by 0 days.

(21) Appl. No.: 14/317,545

(22) Filed: Jun. 27, 2014

(65) Prior Publication Data

US 2014/0305062 A1 Oct. 16, 2014

Related U.S. Application Data

(63) Continuation-in-part of application No. 14/156,989, filed on Jan. 16, 2014.

(60) Provisional application No. 61/753,050, filed on Jan. 16, 2013.

(51) Int. Cl.

| | |
|---|---|
| ***E02D 27/00*** | (2006.01) |
| ***E04C 1/00*** | (2006.01) |
| ***E04B 2/10*** | (2006.01) |
| ***E04C 5/08*** | (2006.01) |
| ***E04B 2/54*** | (2006.01) |
| ***E04B 2/40*** | (2006.01) |

(52) U.S. Cl.

CPC ... *E04C 1/00* (2013.01); *E04B 2/10* (2013.01); *E04C 5/08* (2013.01); *E04B 2/54* (2013.01); *E04B 2/40* (2013.01)

USPC ..... 52/293.2; 52/223.7; 52/607

(58) Field of Classification Search

USPC ..... 52/293.2, 294, 295, 604, 605, 606, 607, 52/592.6, 223.7, 379, 592.1, 439

See application file for complete search history.

(56) References Cited

U.S. PATENT DOCUMENTS

| | | | | | |
|---|---|---|---|---|---|
| 1,588,332 | A | * | 6/1926 | Peters | 52/436 |
| 1,704,255 | A | * | 3/1929 | Lewis | 52/293.2 |
| 1,727,363 | A | * | 9/1929 | Bone | 52/100 |
| 1,884,319 | A | * | 10/1932 | Smith | 52/405.2 |
| 1,974,564 | A | * | 9/1934 | Donovan | 52/591.2 |
| 3,222,830 | A | * | 12/1965 | Ivany | 52/100 |
| 3,296,758 | A | * | 1/1967 | Knudsen | 52/223.7 |
| 3,473,285 | A | * | 10/1969 | Reiland | 52/745.17 |
| 3,512,759 | A | * | 5/1970 | Resler | 256/19 |
| 3,604,180 | A | * | 9/1971 | Wood | 52/649.3 |
| 3,717,967 | A | * | 2/1973 | Wood | 52/259 |
| 3,968,615 | A | * | 7/1976 | Ivany | 52/439 |
| 4,018,018 | A | * | 4/1977 | Kosuge | 52/127.4 |
| 4,091,587 | A | * | 5/1978 | Depka | 52/421 |
| 4,167,840 | A | * | 9/1979 | Ivany | 52/438 |
| 4,207,718 | A | * | 6/1980 | Schaaf et al. | 52/585.1 |
| 4,295,313 | A | * | 10/1981 | Rassias | 52/438 |
| 4,319,440 | A | * | 3/1982 | Rassias et al. | 52/438 |

(Continued)

*Primary Examiner* — James Ference

(74) *Attorney, Agent, or Firm* — Carter, DeLuca, Farrell & Schmidt LLP

(57) ABSTRACT

A masonry unit for constructing built structures includes a rectangular shaped base having a front edge and a rear edge. The front edge and the rear edge each include a recess formed therein configured for disposal of a vertically disposed reinforcing material. A pair of spaced apart sidewalls extends perpendicularly from the base and along a length of the base. The sidewalls and the base together define a cavity configured for disposal of a fill material. A pair of spaced apart bridges is supported on the base configured for disposal of lengths of a horizontally disposed reinforcing material. The bridges extend transversely between the sidewalls and each have a height less than a height of the sidewalls. The base defines a hole therethrough disposed adjacent one bridge of the pair of spaced apart bridges.

20 Claims, 8 Drawing Sheets

(56) References Cited

U.S. PATENT DOCUMENTS

| | | | | | |
|---|---|---|---|---|---|
| 4,426,815 | A * | 1/1984 | Brown | 52/100 |
| 4,473,985 | A * | 10/1984 | Hunt | 52/592.6 |
| 4,514,949 | A * | 5/1985 | Crespo | 52/603 |
| 4,976,087 | A * | 12/1990 | Pizzino | 52/741.15 |
| 5,177,924 | A * | 1/1993 | Kakuk | 52/606 |
| 5,392,580 | A * | 2/1995 | Baumann | 52/660 |
| 5,485,703 | A * | 1/1996 | Nordahl | 52/562 |
| 5,551,198 | A * | 9/1996 | Schaaf et al. | 52/604 |
| 5,553,432 | A * | 9/1996 | Levin | 52/309.12 |
| 5,592,784 | A * | 1/1997 | Nivens | 52/20 |
| 5,839,243 | A * | 11/1998 | Martin | 52/439 |
| 5,862,640 | A * | 1/1999 | Negri | 52/565 |
| 5,881,524 | A * | 3/1999 | Ellison, Jr. | 52/565 |
| 5,901,520 | A * | 5/1999 | Abdul-Baki | 52/592.6 |
| 6,065,265 | A * | 5/2000 | Stenekes | 52/607 |
| 6,138,426 | A * | 10/2000 | Mork et al. | 52/562 |
| 6,195,946 | B1 * | 3/2001 | Lott et al. | 52/100 |
| 6,226,951 | B1 * | 5/2001 | Azar | 52/604 |
| 6,293,071 | B1 * | 9/2001 | Konstantinidis | 52/659 |
| 6,513,293 | B2 * | 2/2003 | Miller | 52/405.1 |
| 6,588,168 | B2 * | 7/2003 | Walters | 52/604 |
| 6,705,057 | B2 * | 3/2004 | Smyer, III | 52/606 |
| 6,758,020 | B2 * | 7/2004 | Cerrato | 52/606 |
| 6,854,231 | B2 * | 2/2005 | MacDonald et al. | 52/562 |
| 7,096,636 | B1 * | 8/2006 | Neill et al. | 52/605 |
| 7,188,453 | B2 * | 3/2007 | Greenberg et al. | 52/223.7 |
| 7,328,537 | B2 * | 2/2008 | Hammer | 52/604 |
| 7,454,870 | B2 * | 11/2008 | Greenberg et al. | 52/293.2 |
| 7,461,487 | B2 * | 12/2008 | Greenberg et al. | 52/293.2 |
| 7,591,447 | B2 * | 9/2009 | Hammer et al. | 249/104 |
| 7,762,033 | B2 * | 7/2010 | Scott et al. | 52/425 |
| 7,905,070 | B2 * | 3/2011 | August | 52/604 |
| 2001/0022057 | A1 * | 9/2001 | Miller | 52/405.1 |
| 2003/0002925 | A1 * | 1/2003 | Blomquist et al. | 405/284 |
| 2003/0009970 | A1 * | 1/2003 | MacDonald et al. | 52/562 |
| 2003/0074856 | A1 * | 4/2003 | Hammer | 52/604 |
| 2005/0108973 | A1 * | 5/2005 | Hammer et al. | 52/596 |
| 2006/0059839 | A1 * | 3/2006 | Azar | 52/606 |
| 2007/0079566 | A1 * | 4/2007 | Neill et al. | 52/284 |
| 2007/0245673 | A1 * | 10/2007 | Cerrato | 52/607 |
| 2008/0184650 | A1 * | 8/2008 | Fischer | 52/606 |
| 2009/0145074 | A1 * | 6/2009 | Tsukamoto | 52/686 |
| 2010/0043335 | A1 | 2/2010 | O'Connor | |
| 2014/0196392 | A1 | 7/2014 | Heron | |

* cited by examiner

MASONRY UNITS AND STRUCTURES FORMED THEREFROM

CROSS-REFERENCE TO RELATED APPLICATIONS

The present application is a continuation-in-part of U.S. patent application Ser. No. 14/156,989, filed on Jan. 16, 2014, which claims the benefit of and priority to U.S. Provisional Patent Application Ser. No. 61/753,050, filed on Jan. 16, 2013, the entire contents of each of which are incorporated herein by reference.

1. TECHNICAL DESCRIPTION

The present disclosure relates to masonry units and structures formed therefrom, and more particularly, to building blocks and systems capable of accommodating a belting or cage arrangement in the construction of buildings, structures or the like.

2. BACKGROUND OF RELATED ART

Masonry units are made of various suitable materials, such as, for example, concrete, to form generally rectangular shaped blocks that can be stacked on top of one another to act as a building material for various load-bearing structures. Concrete masonry units are usually reinforced with rebar to provide the structure greater resistance to lateral forces. Concrete masonry units, however, rely heavily on mortar joints to join individual units to one another. Accordingly, it is desired to have masonry units or concrete blocks that are capable of forming a structure with enhanced strength and stability compared to that provided by concrete masonry units in the prior art.

SUMMARY

In an aspect of an embodiment of the present disclosure, a masonry unit for constructing built structures is provided. The masonry unit includes a rectangular shaped base having a front edge and a rear edge. The front edge and the rear edge each include a recess formed therein configured for disposal of a vertically disposed reinforcing material. A pair of spaced apart sidewalls extends perpendicularly from the base and along a length of the base. The sidewalls and the base together define a cavity configured for disposal of a fill material. A pair of spaced apart bridges is supported on the base configured for disposal of lengths of a horizontally disposed reinforcing material. The bridges extend transversely between the sidewalls and each have a height less than a height of the sidewalls. The base defines a hole therethrough disposed adjacent one bridge of the pair of spaced apart bridges.

In embodiments, a first bridge may have a first side surface and a second side surface, opposite the first side surface. The recess of the front edge may be disposed adjacent the first side surface and the hole may be disposed adjacent the second side surface such that the first bridge is disposed between the recess of the front edge and the hole. The masonry unit may include a channel extending longitudinally along the base from the recess of the front edge to the hole and extending transversely through the first bridge.

In embodiments, the recesses may have a semi-circular profile. In further embodiments, a first bridge of the pair of spaced apart bridges may be adjacent a first recess of the recesses and a second bridge of the pair of spaced apart bridges may be adjacent a second recess of the recesses. It is contemplated that the first recess may occupy an entire area defined between the sidewalls, the first bridge, and the front edge, and the second recess may occupy an entire area defined between the sidewalls, the second bridge, and the rear edge.

In some embodiments, each sidewall may include an outer surface and an inner surface. The outer surfaces may be disposed in parallel relation to one another and the inner surfaces may be angled relative to one another.

It is envisioned that each bridge may have an upper surface that defines a pair of spaced apart grooves each configured for disposal of reinforcing material. The spaced apart grooves may have a semi-circular configuration. In embodiments, the upper surface of each bridge may be spaced from the base to define a height of each bridge.

In another aspect of an embodiment of the present disclosure, a masonry structure is provided. The masonry structure includes a plurality of masonry units. Each masonry unit includes a rectangular shaped base having a front edge and a rear edge. The front edge and the rear edge each include a recess formed therein. A pair of spaced apart sidewalls extend perpendicularly from the base and along a length of the base. The sidewalls and the base together define a cavity configured for disposal of a fill material. A pair of spaced apart bridges is supported on the base. The bridges extend transversely between the sidewalls and each has a height less than a height of the sidewalls. The base defines a hole therethrough disposed adjacent a first bridge of the pair of spaced apart bridges. The masonry units are disposed adjacent to one another such that the front and rear edges of adjacent masonry units are in abutting engagement and form an enclosed passageway defined by the recesses of two adjacent masonry units. A plurality of first reinforcing bars are arranged in parallel to one another to form a cage. The cage is supported by the bridges of the masonry units and is disposed in the cavities of the masonry units. The masonry structure further includes at least one second reinforcing bar disposed in the enclosed passageway of two adjacent masonry units.

In embodiments, a first bridge of the pair of spaced apart bridges has a first side surface and a second side surface, opposite the first side surface. The recess of the front edge may be disposed adjacent the first side surface and the hole may be disposed adjacent the second side surface such that the first bridge is disposed between the recess of the front edge and the hole. It is contemplated that each masonry unit may further include a channel extending longitudinally along the base from the recess of the front edge to the hole and extends transversely through the first bridge.

In embodiments, the plurality of first reinforcing bars and the at least one second reinforcing bar may be perpendicular to one another. The cage may include a plurality of box-like straps that surrounds the plurality of first reinforcing bars. The cage may include a plurality of hooks connecting each first reinforcing bar of the plurality of first reinforcing bars to the straps.

It is contemplated that the masonry structure may further include a plurality of stacked rows of cinder blocks forming at least one wall. The plurality of masonry units cap the at least one wall such that the enclosed passageway of each pair of adjacent masonry units may be in coaxial alignment with holes of the cinder blocks.

In some aspects, the recesses of each masonry unit may have a semi-circular profile.

In further embodiments, a first bridge of the pair of spaced apart bridges of each masonry unit may be adjacent a first recess of the recesses of each masonry unit and a second bridge of the pair of spaced apart bridges of each masonry unit may be adjacent a second recess of the recesses of each masonry unit. The first recess of each masonry unit may occupy an entire area defined between the sidewalls, the first bridge, and the front edge of each masonry unit. The second recess of each masonry unit may occupy an entire area defined between the sidewalls, the second bridge, and the rear edge of each masonry unit.

It is envisioned that the bridges of each masonry unit may have an upper surface that defines a pair of spaced apart grooves each configured for disposal of one of the plurality of first reinforcing bars. The spaced apart grooves of the bridges of each masonry unit may have a semi-circular configuration. In embodiments, the upper surface of each bridge may be spaced from the base to define a height of each bridge.

In yet another aspect of an embodiment of the present disclosure, a concrete building block for constructing built structures is provided. The concrete building block includes a rectangular shaped base having a front edge and a rear edge. The front edge and the rear edge each include a recess formed therein configured for disposal of a vertically disposed reinforcing bar. Each recess has a semi-circular profile. The concrete building block further includes a pair of spaced apart sidewalls extending perpendicularly from the base and along a length of the base. The sidewalls and the base together define a cavity configured for disposal of a fill material. The concrete building block further includes a pair of spaced apart trapezoidal-shaped bridges supported on the base and configured for disposal of lengths of horizontally disposed reinforcing bars. The bridges extend transversely between the sidewalls and each have a height less than a height of the sidewalls. Each bridge has an upper surface that is spaced from the base to define a height of each bridge.

BRIEF DESCRIPTION OF DRAWINGS

In order that the present disclosure may be clearly understood, preferred embodiments thereof will be described below with reference to the accompanying drawings, in which.

Figure 1:
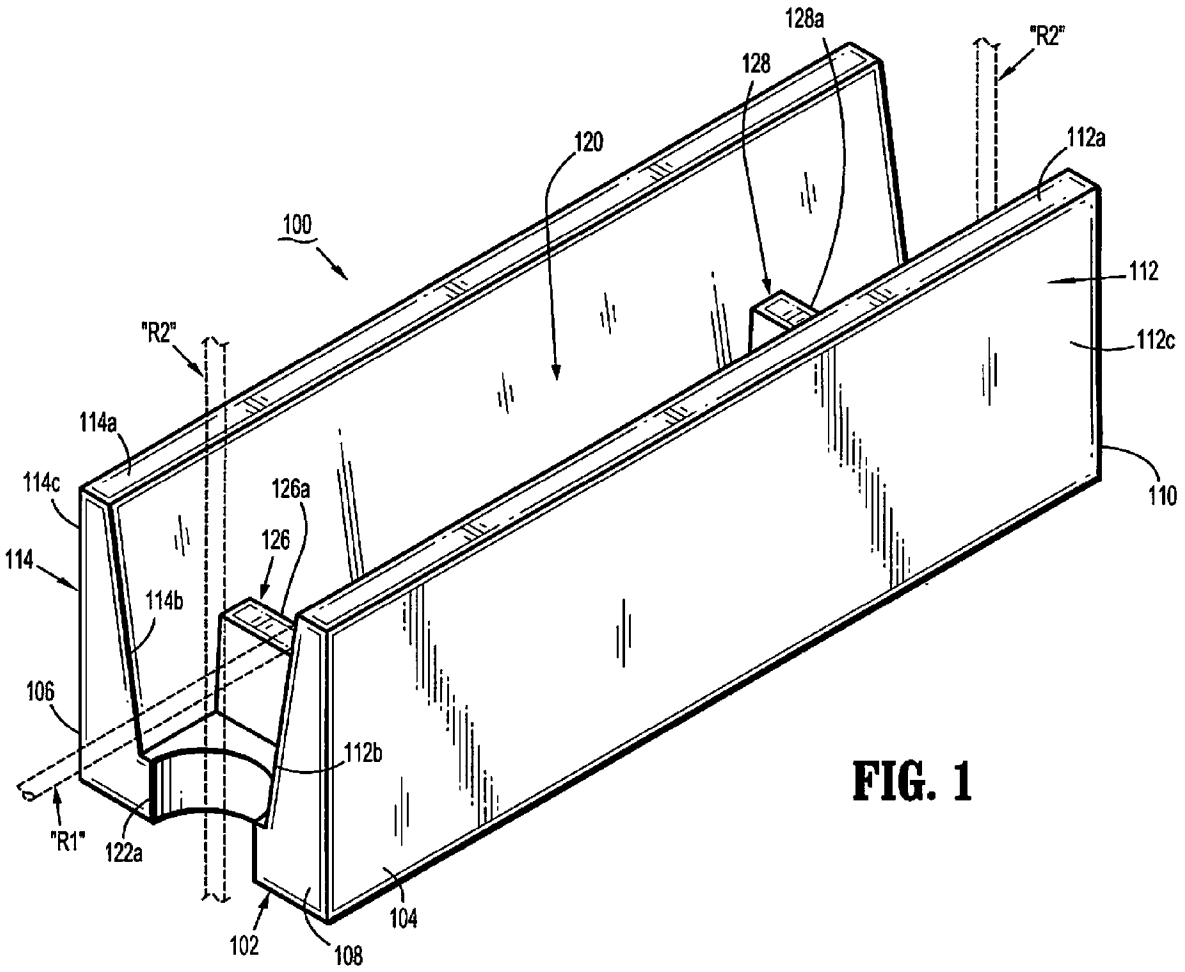
FIG. 1 is a perspective view of a building block according to an embodiment of the present disclosure.

As used herein, the terms parallel and perpendicular are understood to include relative configurations that are substantially parallel and substantially perpendicular up to about + or −10 degrees from true parallel and true perpendicular.

DETAILED DESCRIPTION OF EMBODIMENTS

Referring to the drawings and initially to FIGS. 1-4 there is shown a full masonry unit, such as, for example, a building block, in accordance with an embodiment of the present disclosure, and is generally designated as building block 100.

As seen in FIGS. 1-4, building block 100 includes a base 102 defining a pair of opposed, parallel side edges 104, 106, a front edge 108 and a rear edge 110. Base 102 of building block 100 is substantially rectangular having a length "L" (e.g., about 15½ inches) and a width "W" (e.g., about 7½ inches).

Building block 100 includes a pair of spaced apart side walls 112, 114 extending from respective side edges 104, 106 of base 102. Each side wall 112, 114 has a height "H" (e.g., e.g., about 7½ inches) and terminates in an upper edge or surface 112*a*, 114*a*. Each wall 112, 114 extends substantially orthogonally from base 102. Each wall 112, 114 includes a respective inner surface 112*b*, 114*b*, wherein inner surfaces 112*b*, 114*b* are angles with respect to base 102 so as to extend towards one another from respective upper surfaces 112*a*, 114*a* toward base 102. In other words, each wall 112, 114 includes a respective outer surface 112*c*, 114*c* extending substantially orthogonally to base 102 and being substantially parallel to one another, and respective inner surfaces 112*b*, 114*b* that are angled with respect to respective outer surfaces 112*c*, 114*c* and which extend toward one another from respective upper surfaces 112*a*, 114*a* toward base 102. As so configured, a channel or cavity 120 is defined within building block 100.

With continued reference to FIGS. 1-4, building block 100 includes at least a first bridge 126 supported on or extending from base 102 and extending transversely between inner surface 112*b* of side wall 112 and inner surface 114*b* of side wall 114, and a second bridge 128 supported on or extending from base 102 and extending transversely between inner surface 112*b* of side wall 112 and inner surface 114*b* of side wall 114. Bridges 126, 128 may have a trapezoidal shape. In some embodiments, bridges 126, 128 can be variously configured, such as, for example, concave, undulating, scalloped, squared, uniform, non-uniform and/or tapered. Each bridge 126, 128 defines a respective upper edge or surface 126*a*, 128*a* having a height "h" above base 102. Height "h" of bridges 126, 128 is less than height "H" of building block 100, wherein upper surfaces 126*a*, 128*a* of bridges 126, 128 are disposed below upper surfaces 112*a*, 114*a* of side walls 112, 114. For example, bridges 126, 128 may have a height "h" of about 1-4 inches above an upper surface of base 102.

Figure 2:
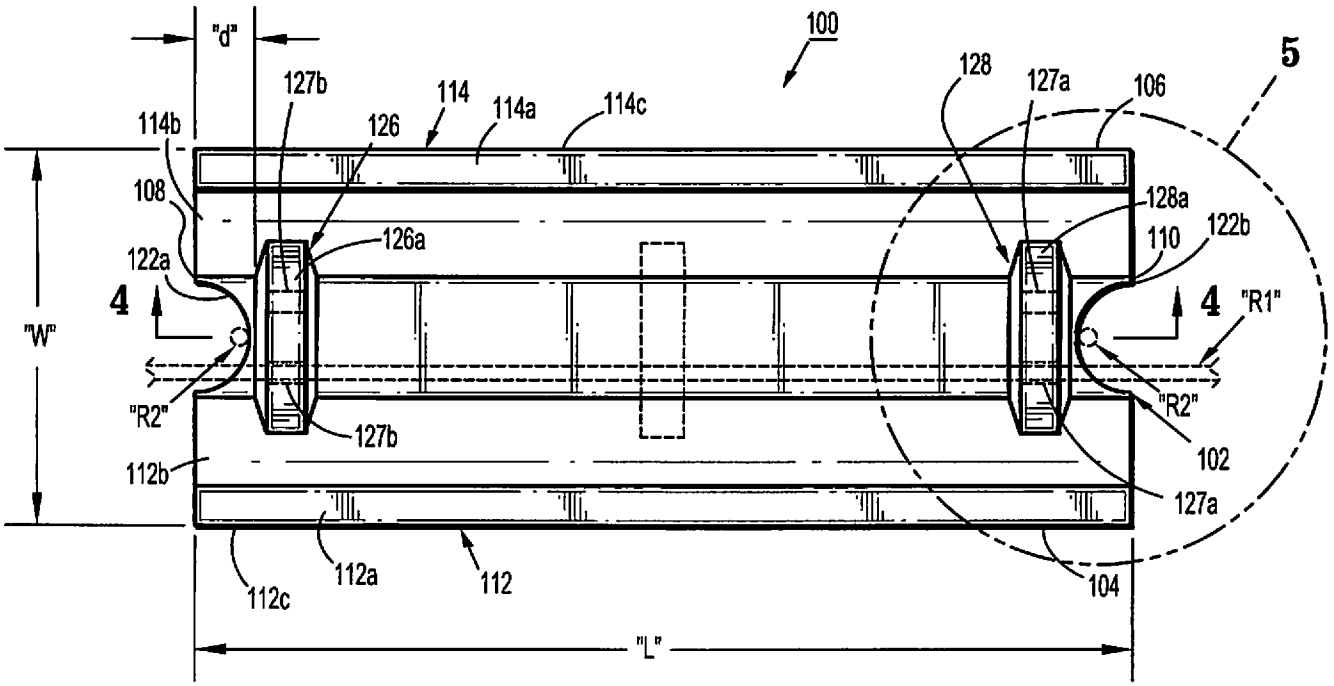
FIG. 2 is a top, plan view of the building block of FIG. 1.
Figure 4:
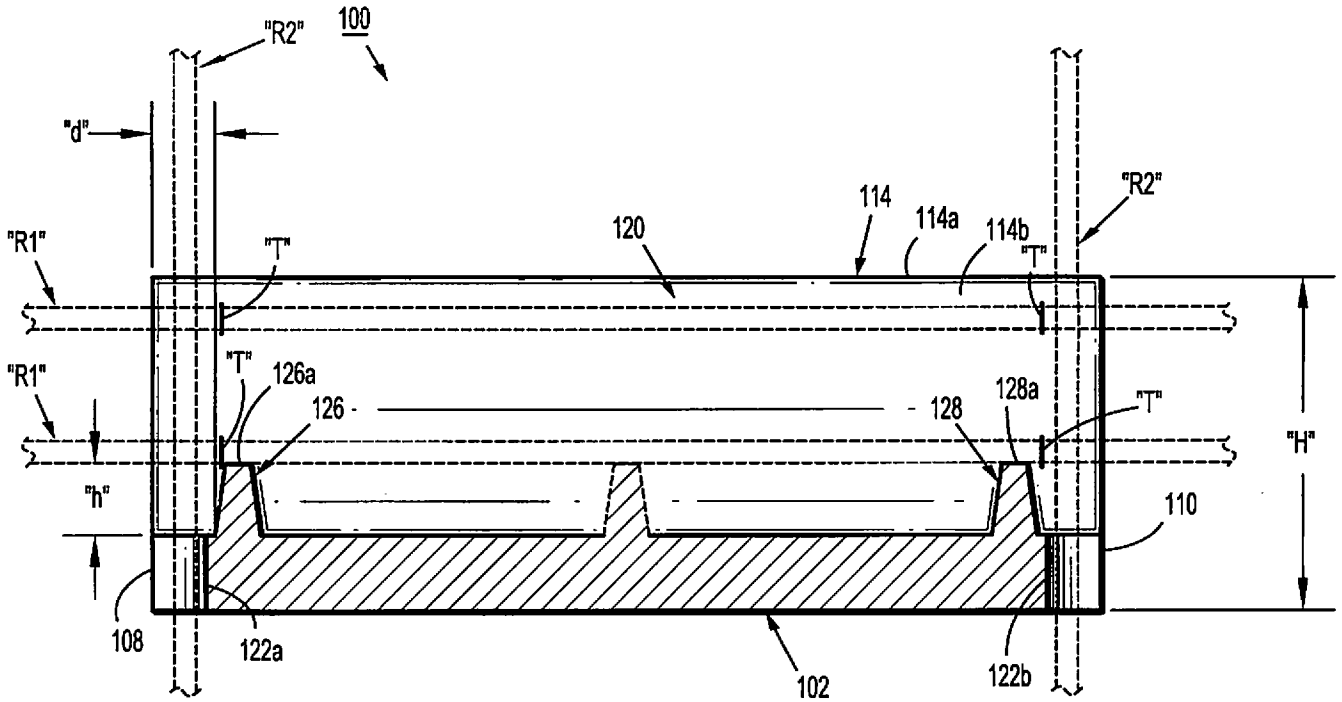
FIG. 4 is a cross-sectional view of the building block of FIGS. 1-3, as taken through 4-4 of FIGS. 2 and 3.

As seen in FIGS. 2 and 4, bridges 126, 128 are spaced a distance "d" from respective front edge 108 and rear edge 110 of base 102. For example, bridges 126, 128 may be spaced a distance "d" of about 1-4 inches from respective front edge 108 and rear edge 110 of base 102.

In accordance with the present disclosure, each of bridges 126, 128 may include a pair of spaced apart grooves 127*a*, 127*b* (shown in phantom in FIGS. 2 and 5) defined in upper surfaces 126*a*, 128*a*, respectively. Grooves 127*a*, 127*b* are configured for disposal of reinforcing material "R1." Grooves 127*a*, 127*b* may have a semi-circular configuration such that reinforcing material "R1" can be slidingly disposed in grooves 127*a*, 127*b*.

As so configured, bridges 126, 128 may support lengths of first reinforcing material "R1" (e.g., bars, rebar, pipes, tubes, etc.) thereon, in a horizontal orientation, wherein first reinforcing material or bars "R1" are located within channel or cavity 120 of building block 100 between side walls 112, 114. In this manner, first reinforcing bars "R1" are raised above a top surface 302*a* of base 102 when first reinforcing bars "R1" are located or disposed within channel or cavity 120.

While a pair of bridges 126, 128 are shown and provided, in accordance with the present disclosure, additional bridges (shown in phantom in FIGS. 2 and 4) may be provided between bridges 126, 128.

With reference to FIGS. 1-4, building block 100 includes a cut-out or recess 122*a*, 122*b* formed in each of respective front edge 108 and rear edge 110 of base 102. In particular, each recess 122*a*, 122*b* is located between side walls 112 and 114, and extends completely through base 102. In embodiments, recesses 122*a*, 122*b* may extend into respective front edge 108 and rear edge 110 of base 102 up to respective bridges 126, 128. Each recess 122*a*, 122*b* may have a substantially semi-circular profile or footprint. While building block 100 is shown and described as including a cut-out or recess 122*a*, 122*b* formed in each side of base 102, it is contemplated and envisioned that building block 100 may include only one cut-out or recess formed in one edge of base 102, either front edge 108 or rear edge 110.

Figure 5:
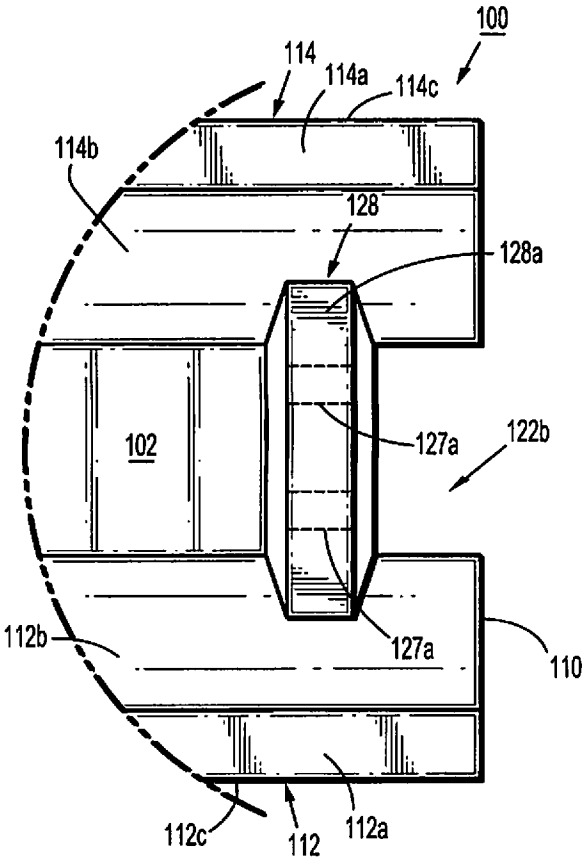
FIG. 5 is an enlarged view of the indicated area of detail of FIG. 3, illustrating and end of building block according to another embodiment of the present disclosure.
Figure 3:
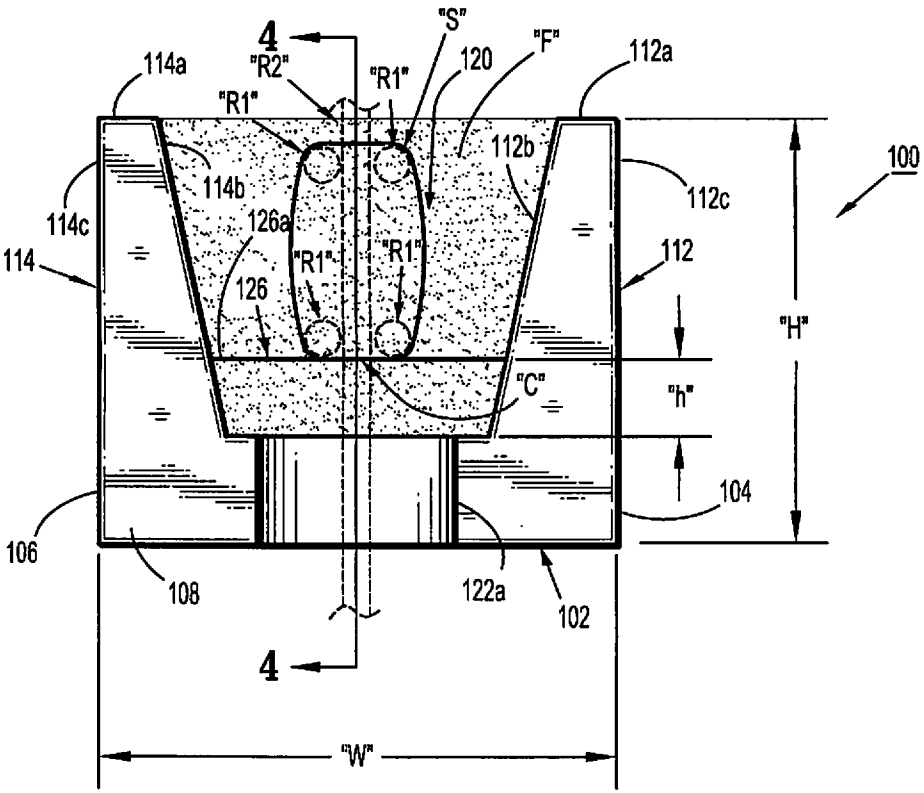
FIG. 3 is a front, elevational view of the building block of FIGS. 1 and 2.

In an embodiment, as seen in FIG. 5, recesses 122*a*, 122*b* may constitute the entire area defined between side walls 112, 114, respective bridges 126, 128, and respective front edge 108 or rear edge 110.

In use, when building blocks 100 are placed adjacent to one another such that a front edge 108 of a first building block 100 abuts or is adjacent a second edge 110 of a second building block 100, recess 122*a* of first building block 100 is adjacent recess 122*b* of second building block. In this manner, as seen in FIGS. 1-4, lengths of second reinforcing material "R2" (e.g., bars, rebar, pipes, tubes, etc.) may be disposed within combined recess 122*a*/122*b*, in a vertical orientation, wherein second reinforcing bar "R2" is located between adjacent building blocks 100.

As seen in FIGS. 3-7, a plurality of reinforcing bars "R1" are arranged in parallel to one another in the configuration of a box or cage "C", with a plurality of rigid square or box-like belts or straps "S" surrounding the plurality of reinforcing bars "R1" making up cage "C", and with a tie of hook "T" connecting each reinforcing bar "R1" to a respective inner corner of strap "S". With cage "C" formed in this manner, cage "C" is placed in cavity 120 of building blocks 100 such that a first pair of reinforcing bars "R1" are disposed atop bridges 126, 128, and a second pair of reinforcing bars "R1" are disposed a distance upwardly from bridges 126, 128.

Figure 6:
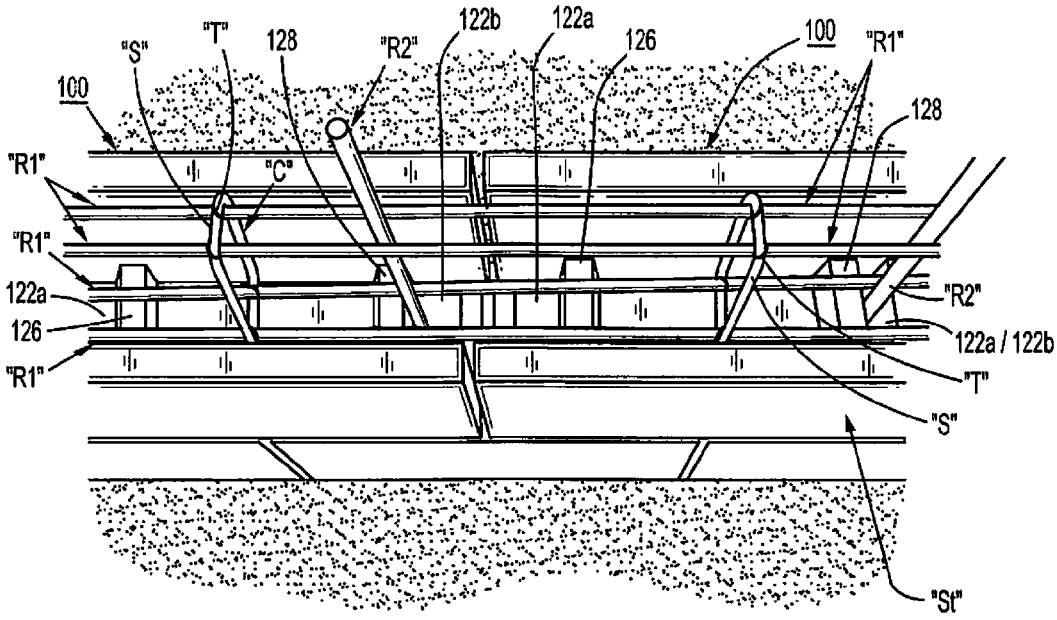
FIG. 6 is a first perspective view of a partial construction of a wall or structure including a plurality of building blocks of FIGS. 1-5.
Figure 7:
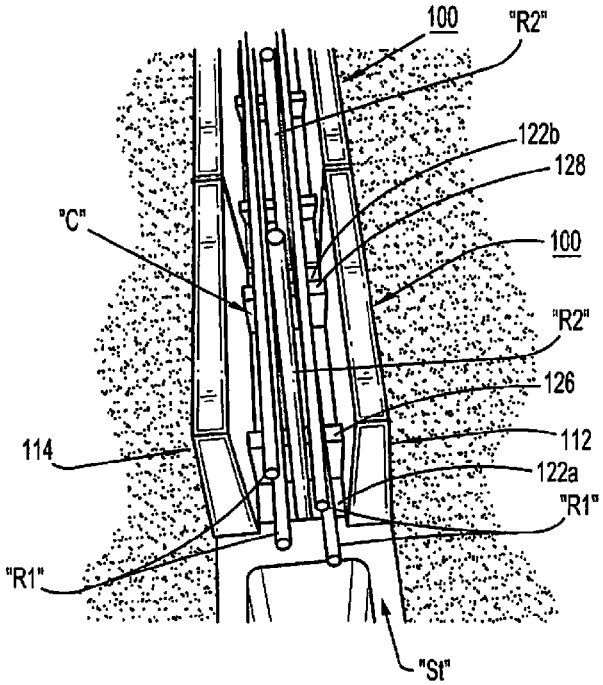
FIG. 7 is a second perspective view of the partial construction of the wall or structure of FIG. 6.

With reference now to FIGS. 6 and 7, when constructing a masonry structure "St" (i.e., wall or the like) with building blocks 100, a plurality of cages "C" may be laid, in a horizontal orientation, into cavities 120 of building blocks 100, along at least a portion, preferably an entire length, of the structure "St". If cages "C" extend completely around a perimeter of the structure "St", cages "C" may substantially define a belt or the like around the structure "St". It is contemplated that instead of using a plurality of cages "C," one cage "C" can be used. In some embodiments, one cage "C" can be bent to form a belt or the like and disposed into cavities 120 of building blocks 100.

Also, when constructing the structure 'St" with building blocks 100, multiple second reinforcing materials "R2" may be inserted, in a vertical orientation, into combined recess or enclosed passageway 122*a*/122*b* between adjacent building blocks 100, all along at least a portion, preferably an entire height, of the structure "St". In use, if second reinforcing materials "R2" are used in combination with cages "C", cages "C" and second reinforcing materials "R2" may substantially define an overall cage structure or the like for structure "St".

In use, following a laying of each row of building blocks 100, and a placement of cages "C" in the cavities 120 thereof, the cavities 120 may be filled with fill material "F", including and not limited to uncured flowable concrete, sand, gravel, dirt, stone, crushed concrete or the like, and any combinations thereof. Since cages "C" are supported on bridges 126, 128, the uncured flowable concrete may completely surround and envelope first reinforcing materials "R1" of cages "C".

Due to the relative dimensions and sizes of reinforcing materials "R1", "R2" and cages "C", lengths of bridges 126, 128, and widths of recesses 122*a*, 122*b*, in accordance with the present disclosure, it is contemplated that reinforcing materials "R1", "R2" and cages "C" may be positioned any where along the length of bridges 126, 128, or the width of recesses 122*a*, 122*b*. It is further contemplated that multiple reinforcing materials "R1", "R2" may be used at desired or needed locations of structure "St".

Figure 8:
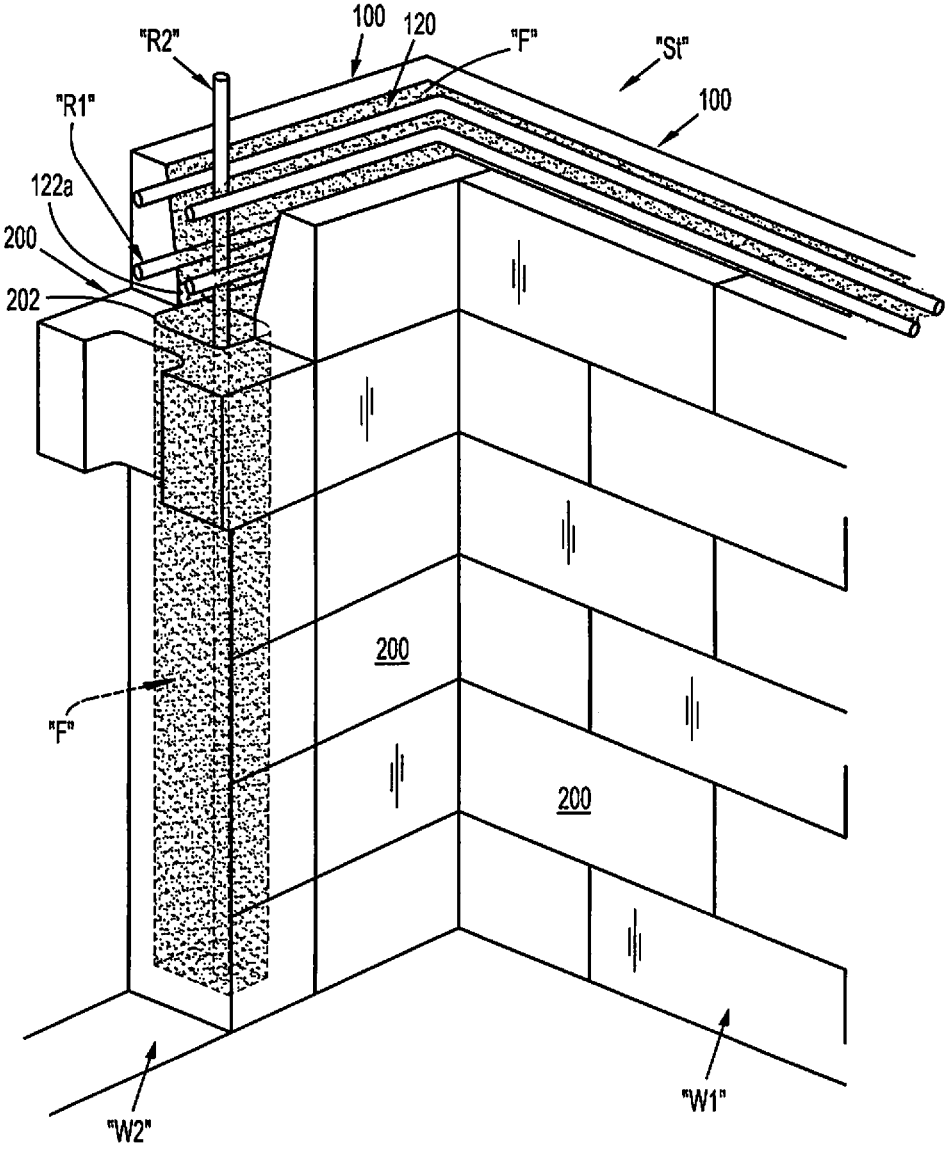
FIG. 8 is a perspective view of a partial wall construction, constructed in accordance with the building blocks and methods of the present disclosure.

Turning now to FIG. 8, in a construction or structure "St", a plurality of rows of cinder blocks 200 are stacked in accordance with known construction techniques to create at least one wall (here, a pair of walls "W1," "W2"). In accordance with the present disclosure, a row of building blocks 100 are disposed atop walls "W1," "W2" to cap walls "W1," "W2". In accordance with the present disclosure, recess 122*a*/(122*b* not shown) of building blocks 100 align with the holes or passages 202 of under lying cinder blocks 200. As so arranged, reinforcing material "R2" (i.e., rebar) in inserted into walls "W1, W2" so as to extend through recess 122*a*/(122*b* not shown) of building blocks 100 and holes or passages 202 of under lying cinder blocks 200. Additionally, fill material "F" may be used to fill cavities 120 of the upper row of building blocks 100, as well as to flow down into recess 122*a*/(122*b* not shown) of building blocks 100 and holes or passages 202 of under lying cinder blocks 200.

The use of rebar "R2" and fill material "F" in a vertical column adds strength and rigidity to the walls "W1, W2" of structure "St".

In accordance with the present disclosure, it is contemplated that any row of cinder blocks 200 of structure "St" may be replaced with a row of building blocks 100 of the present disclosure. Additionally, it is envisioned and contemplated that each row of building blocks 100 may include a cage "C" supported therein and then the respective cavity 120 filled with fill material "F".

Figure 9:
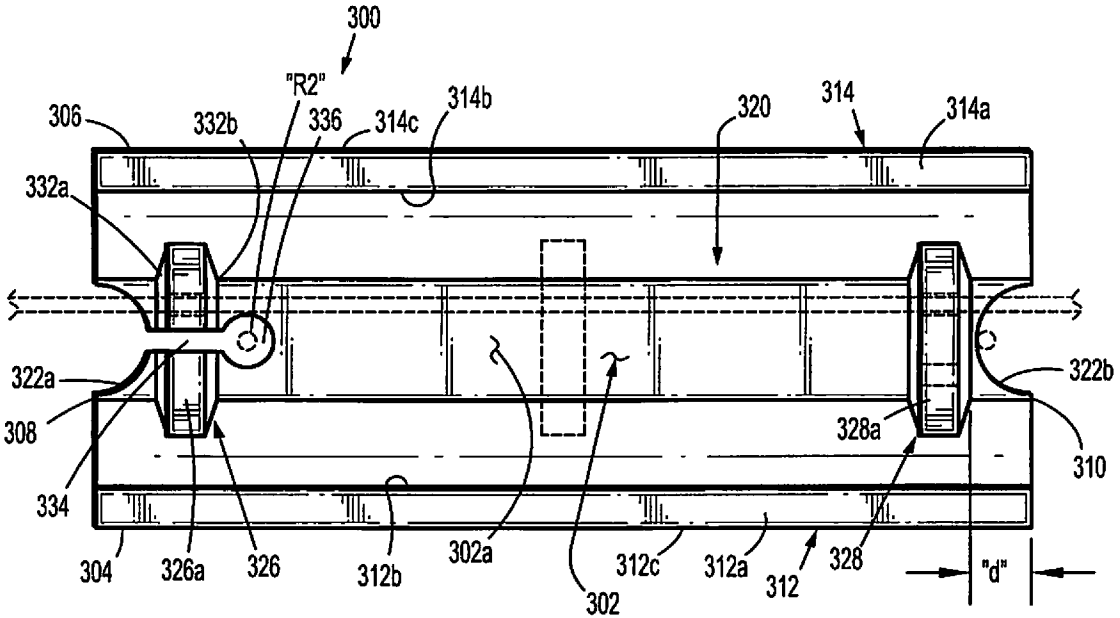
FIG. 9 is a top, plan view of another embodiment of a building block in accordance with the principles of the present disclosure.
Figure 10:
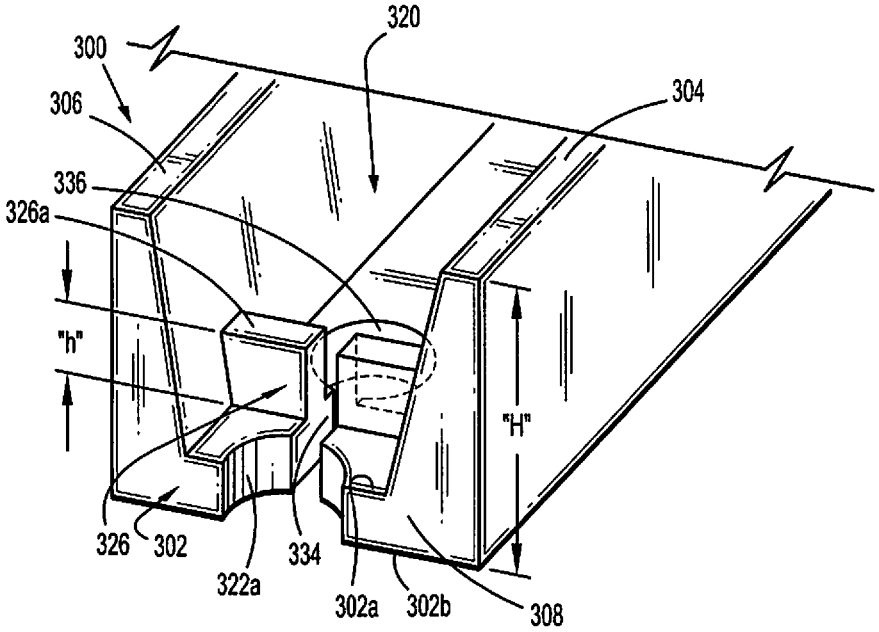
FIG. 10 is a front, perspective view of the building block shown in FIG. 9.

With reference to FIGS. 9 and 10, there is shown another embodiment of a full masonry unit, such as, for example, a building block, similar to building block 100 discussed above with regard to FIGS. 1-8, and is generally designated as building block 300. Building block 300 includes a base 302 defining a pair of opposed, parallel side edges 304, 306, a front edge 308, and a rear edge 310.

Building block 300 includes a pair of spaced apart side walls 312, 314 extending from respective side edges 304, 306 of base 302. Each side wall 312, 314 has a height "H" (e.g., e.g., about 7½ inches) (See FIG. 10) and terminates in an upper edge or surface 312*a*, 314*a*. Each wall 312, 314 extends substantially orthogonally from base 302. Each wall 312, 314 includes a respective inner surface 312*b*, 314*b*, wherein inner surfaces 312*b*, 314*b* are angled with respect to base 302 so as to extend towards one another from respective upper surfaces 312*a*, 314*a* toward base 302. In other words, each wall 312, 314 includes a respective outer surface 312*c*, 314*c* extending substantially orthogonally to base 302 and being substantially parallel to one another, and respective inner surfaces 312*b*, 314*b* that are angled with respect to respective outer surfaces 312*c*, 314*c* and which extend toward one another from respective upper surfaces 312*a*, 314*a* toward base 302. As so configured, a channel or cavity 320 is defined within building block 300.

Building block 300 includes at least a first bridge 326 supported on or extending from base 302 and extending transversely between inner surface 312*b* of side wall 312 and inner surface 314*b* of side wall 314, and a second bridge 328 supported on or extending from base 302 and extending transversely between inner surface 312*b* of side wall 312 and inner surface 314*b* of side wall 314. Bridges 326, 328 may have a trapezoidal shape. Each bridge 326, 328 defines a respective upper edge or surface 326*a*, 328*a* spaced from top surface 302*a* of base 302 to define a height "h" above base 302 (See FIG. 10). Height "h" of bridges 326, 328 is less than height "H" of building block 300, wherein upper surfaces 326*a*, 328*a* of bridges 326, 328 are disposed below upper surfaces 312*a*, 314*a* of side walls 312, 314. For example, bridges 326, 328 may have a height "h" of about 1-4 inches above an upper surface of base 302. Bridges 326, 328 are spaced a distance "d" from respective front edge 308 and rear edge 310 of base 302. For example, bridges 326, 328 may be spaced a distance "d" of about 6-7 inches from respective front edge 308 and rear edge 310 of base 302.

First bridge 326 further includes a first side surface or face 332*a* and a second side surface or face 332*b*, opposite first side surface 332*a*. First side surface 332*a* is oriented towards front edge 308 of base 302 and second side surface 332*b* is oriented away from front edge 308 of base 302 and towards rear edge 310 of base 302.

Building block 300 includes a cut-out or recess 322*a*, 322*b* formed in each of respective front edge 308 and rear edge 310 of base 302. In particular, each recess 322*a*, 322*b* is located between side walls 312 and 314, and extends completely through base 302. Recess 322*a* of front edge 308 is disposed adjacent first side surface 332*a* of first bridge 326. In embodiments, recesses 322*a*, 322*b* may extend into respective front edge 308 and rear edge 310 of base 302 up to respective bridges 326, 328. Each recess 322*a*, 322*b* may have a substantially semi-circular profile or footprint.

Building block 300 includes a channel or passageway 334 extending longitudinally along base 302 from recess 322*a* and transversely through bridge 326. Passageway 334 has a linear configuration and has a height extending from a bottom surface 302*b* of base 302 to upper surface 326*a* of bridge 326 such that bridge 326 is divided into two, spaced apart portions by passageway 334. In embodiments, passageway 334 may only extend from upper surface 326*a* of bridge 326 to top surface 302*a* of base 302 and not through the entire thickness of base 302.

Building block 300 further includes an opening or hole 336 defined through the thickness of base 302. Hole 336 has a rounded configuration and a diameter of approximately 3 inches. It is contemplated that hole 336 is variously configured, such as, for example, those alternatives described herein, and may be approximately 2-4 inches in diameter. Hole 336 is disposed adjacent second side surface 332*b* of first bridge 326 such that first bridge 326 is disposed between recess 322*a* of front edge 308 and hole 336. Hole 326 is in communication with recess 322*a* via passageway 334. Hole 336 is configured for disposal of a vertically oriented support member, such as, for example, rebar. In embodiments, building block 300 may include an additional passageway and hole that are disposed adjacent rear surface 310.

In accordance with the present disclosure, and without limiting the present application, building blocks 100, 300 may be fabricated from any curable, castable and/or moldable cementitious material, such as, for example, concrete, cement, cement/polymer mixtures, concrete mixed with polystyrene, recycles concrete (RCA), crushed concrete, wood, clay, ceramics, aluminum, steel, rubber, etc. and combinations thereof.

Consideration must be given to the fact that although present disclosure has been shown, described, and disclosed in relation to certain preferred embodiments, obvious equivalent modifications and alterations thereof will become apparent to one of ordinary skill in this art upon reading and understanding this specification and the claims appended hereto. Accordingly, the presently disclosed invention is intended to cover all such modifications and alterations, and is limited only by the scope of the claims which follow.

What is claimed is:

1. A masonry unit for constructing built structures, the masonry unit comprising:

a rectangular shaped base having a front edge and a rear edge, the front edge and the rear edge each including a recess formed therein configured for disposal of a vertically disposed reinforcing material;

a pair of spaced apart sidewalls extending perpendicularly from the base and along a length of the base, the sidewalls and the base together defining a cavity configured for disposal of a fill material;

a pair of spaced apart bridges supported on the base configured for disposal of lengths of horizontally disposed reinforcing materials, the bridges extending transversely between the sidewalls and each bridge of the pair of spaced apart bridges having a height less than a height of the sidewalls, wherein the base defines a hole therethrough disposed adjacent one bridge of the pair of spaced apart bridges; and a channel extending longitudinally along the base from the recess of the front edge of the base to the hole of the base and entirely through the height of the one bridge of the pair of spaced apart bridges.

2. The masonry unit according to claim 1, wherein the one bridge of the pair of spaced apart bridges has a first side surface and a second side surface, opposite the first side surface, the recess of the front edge is disposed adjacent the first side surface and the hole is disposed adjacent the second side surface such that the one bridge of the pair of spaced apart bridges is disposed between the recess of the front edge and the hole.

3. The masonry structure according to claim 2, wherein each bridge of the pair of spaced apart bridges has an upper surface that is spaced from the base to define the height of each bridge of the pair of spaced apart bridges, wherein a portion of the channel that is defined longitudinally between the first side surface and the second side surface of the one bridge of the pair of spaced apart bridges has a height that extends between the upper surface of the one bridge of the pair of spaced apart bridges and a bottom surface of the base.

4. The masonry unit according to claim 1, wherein the channel defines a plane in parallel alignment with the pair of spaced apart sidewalls and extending transversely through the one bridge of the pair of spaced apart bridges such that a vertically disposed reinforcing bar is longitudinally movable through the channel between the recess of the front edge of the base and the hole of the base.

5. The masonry unit according to claim 1, wherein the recesses have a semi-circular profile.

6. The masonry unit according to claim 1, wherein a first bridge of the pair of spaced apart bridges is adjacent a first recess of the recesses and a second bridge of the pair of spaced apart bridges is adjacent a second recess of the recesses.

7. The masonry unit according to claim 6, wherein the first recess occupies an entire area defined between the sidewalls, the first bridge, and the front edge, and the second recess occupies an entire area defined between the sidewalls, the second bridge, and the rear edge.

8. The masonry unit according to claim 1, wherein each sidewall of the pair of spaced apart sidewalls includes an outer surface and an inner surface, the outer surfaces being disposed in parallel relation to one another and the inner surfaces being angled relative to one another.

9. A masonry structure, comprising:

a plurality of masonry units, each masonry unit of the plurality of masonry units including:

a rectangular shaped base having a front edge and a rear edge, the front edge and the rear edge each including a recess formed therein;

a pair of spaced apart sidewalls extending perpendicularly from the base and along a length of the base, the sidewalls and the base together defining a cavity configured for disposal of a fill material;

a pair of spaced apart bridges supported on the base, the bridges extending transversely between the sidewalls and each bridge of the pair of spaced apart bridges having a height less than a height of the sidewalls, the base defining a hole therethrough disposed adjacent one bridge of the pair of spaced apart bridges, wherein the masonry units are disposed adjacent to one another such that the front and rear edges of adjacent masonry units are in abutting engagement and form an enclosed passageway defined by the recesses of two adjacent masonry units; and a channel extending longitudinally along the base from the recess of the front edge of the base to the hole of the base and entirely through the height of the one bridge of the pair of spaced apart bridges;

a plurality of first reinforcing bars arranged in parallel to one another to form a cage, the cage being supported by the bridges of the masonry units and disposed in the cavities of the masonry units; and at least one second reinforcing bar disposed in the enclosed passageway of two adjacent masonry units.

10. The masonry structure according to claim 9, wherein the one bridge of the pair of spaced apart bridges has a first side surface and a second side surface, opposite the first side surface, the recess of the front edge is disposed adjacent the first side surface and the hole is disposed adjacent the second side surface such that the one bridge of the pair of spaced apart bridges is disposed between the recess of the front edge and the hole.

11. The masonry structure according to claim 10, wherein the channel defines a plane in parallel alignment with the pair of spaced apart sidewalls and extending transversely through the one bridge of the pair of spaced apart bridges such that a vertically disposed reinforcing bar is longitudinally movable through the channel between the recess of the front edge of the base and the hole of the base.

12. The masonry structure according to claim 10, wherein each bridge of the pair of spaced apart bridges of each masonry unit of the plurality of masonry units has an upper surface that is spaced from the base to define a height of each bridge of the pair of spaced apart bridges, wherein a portion of the channel that is defined longitudinally between the first side surface and the second side surface of the one bridge of the pair of spaced apart bridges has a height that extends between the upper surface of the one bridge of the pair of spaced apart bridges and a bottom surface of the base.

13. The masonry structure according to claim 9, wherein the plurality of first reinforcing bars and the at least one second reinforcing bar are perpendicular to one another.

14. The masonry structure according to claim 9, wherein the cage includes a plurality of straps that surround the plurality of first reinforcing bars.

15. The masonry structure according to claim 14, wherein the cage includes a plurality of hooks connecting each first reinforcing bar of the plurality of first reinforcing bars to the straps.

16. The masonry structure according to claim 15, further comprising a plurality of stacked rows of cinder blocks forming at least one wall, wherein the plurality of masonry units cap the at least one wall such that the enclosed passageway of each pair of adjacent masonry units is in coaxial alignment with holes of the cinder blocks.

17. The masonry structure according to claim 9, wherein the recesses of each masonry unit of the plurality of masonry units has a semi-circular profile.

18. The masonry structure according to claim 9, wherein a first bridge of the pair of spaced apart bridges of each masonry unit of the plurality of masonry units is adjacent a first recess of the recesses of each masonry unit of the plurality of masonry units and a second bridge of the pair of spaced apart bridges of each masonry unit of the plurality of masonry units is adjacent a second recess of the recesses of each masonry unit of the plurality of masonry units.

19. The masonry structure according to claim 18, wherein the first recess of each masonry unit of the plurality of masonry units occupies an entire area defined between the sidewalls, the first bridge, and the front edge of each masonry unit of the plurality of masonry units, and the second recess of each masonry unit of the plurality of masonry units occupies an entire area defined between the sidewalls, the second bridge, and the rear edge of each masonry unit of the plurality of masonry units.

20. A concrete building block for constructing built structures, the concrete building block comprising:

a rectangular shaped base having a front edge and a rear edge, the front edge and the rear edge each including a recess formed therein configured for disposal of a vertically disposed reinforcing bar, the recesses having a semi-circular profile;

a pair of spaced apart sidewalls extending perpendicularly from the base and along a length of the base, the sidewalls and the base together defining a cavity configured for disposal of a fill material;

a pair of spaced apart trapezoidal-shaped bridges supported on the base and configured for disposal of lengths of horizontally disposed reinforcing bars, the bridges extending transversely between the sidewalls and each bridge of the pair of spaced apart trapezoidal-shaped bridges having a height less than a height of the sidewalls, the base defining a hole therethrough disposed adjacent one bridge of the pair of spaced apart trapezoidal-shaped bridges, wherein each bridge of the pair of spaced apart trapezoidal-shaped bridges has an upper surface that is spaced from the base to define the height of each bridge of the pair of spaced apart trapezoidal-shaped bridges; and a channel extending longitudinally along the base from the recess of the front edge of the base to the hole of the base and entirely through the height of the one bridge of the pair of spaced apart trapezoidal-shaped bridges such that a vertically disposed reinforcing bar is longitudinally movable through the channel between the recess of the front edge of the base and the hole of the base.

* * * * *